United States Patent [19]

Armstrong et al.

[11] 4,425,187

[45] Jan. 10, 1984

[54] TWIN-WIRE PAPERMAKING MACHINE

[75] Inventors: Frederick R. Armstrong, Centerville, Mass.; Heinz Braun; Alfred Bubik, both of Ravensburg, Fed. Rep. of Germany; Helmut Störr, Berg, Fed. Rep. of Germany; Karl Turobin-Ort, Meckenbeuren, Fed. Rep. of Germany

[73] Assignee: Escher Wyss GmbH, Ravensburg, Fed. Rep. of Germany

[21] Appl. No.: 364,469

[22] Filed: Apr. 1, 1982

[30] Foreign Application Priority Data

Apr. 8, 1981 [CH] Switzerland ..... 2358/81

[51] Int. Cl.[3] ..... D21F 1/36; D21F 1/40

[52] U.S. Cl. ..... 162/299; 162/300

[58] Field of Search ..... 162/298, 299, 300, 301, 162/303, 123, 132, 203

[56] References Cited

U.S. PATENT DOCUMENTS

| | | | |
|---|---|---|---|
| 3,565,757 | 2/1971 | Jordansson | 162/301 |
| 3,844,881 | 10/1974 | Moody | 162/299 X |
| 3,884,756 | 5/1975 | Gustafson | 162/299 |
| 3,891,501 | 6/1975 | Oka et al. | 162/299 X |
| 3,985,612 | 10/1976 | Watanabe | 162/299 X |
| 4,176,005 | 11/1979 | Bubik et al. | 162/301 X |

*Primary Examiner*—Richard V. Fisher

*Attorney, Agent, or Firm*—Werner W. Kleeman

[57] ABSTRACT

A twin-wire papermaking machine contains a headbox for forming a first fiber ply which is essentially downwardly dewatered at a section of a first wire. At the end of this wire section, forwardly or upstream of the inbound or on-running location of a second wire there is arranged a second headbox for forming a second fiber ply which is essentially upwardly dewatered along a subsequently arranged common path of both wires. The common path advantageously extends over an essentially water impervious, convex domed contact surface of a slide shoe and/or a jacket surface of a guide cylinder or roll. During operation, the second fiber ply is deposited upon the already extensively dewatered first fiber ply and upon passage through the common path of both wires this second fiber ply is dewatered upwardly away from the first fiber ply. This enables separate dewatering of both fiber plies, and there is particularly avoided deflocculation of individual fibers, and thus, impairment of the fiber formation in the initially formed ply.

8 Claims, 4 Drawing Figures

TWIN-WIRE PAPERMAKING MACHINE

BACKGROUND OF THE INVENTION

The present invention relates to a new and improved construction of a twin-wire papermaking machine.

Generally speaking, the twin-wire papermaking machine of the present development is of the type comprising a headbox for forming a first fiber ply and contains a pre-dewatering path located at a first wire and which is arranged after or downstream of the headbox. This pre-dewatering path serves for dewatering the fiber ply essentially in a downward direction. Arranged downstream of the first wire is a common path formed by the first wire and a second wire and serving for dewatering the fiber ply essentially in an upward direction.

The twin-wire papermaking machine of the aforementioned type is known to the art from U.S. Pat. No. 4,176,005, granted Nov. 27, 1979. In order to fabricate at such type of papermaking machine paper composed of a number of layers or plies, it is known for instance to use a multiple headbox which contains a nozzle channel subdivided by intermediate or partition walls into partial channels or sub-passages. Through such partial channels different types of stock suspensions are guided separately from one another almost immediately up to the region of the headbox outlet gap or slice and then are almost simultaneously deposited upon the first wire. For the same purpose it is also known to provide a second headbox arranged following the first headbox and before the pre-dewatering path. By means of the second headbox there is deposited one or a number of additional fiber layers or plies upon the single or multi-ply fiber web which is already located upon the first wire and which has been formed by the first headbox.

With the state-of-the-art constructions it is necessary during the fabrication of multi-ply paper composed of a plurality of fiber layers or plies, to always dewater, for instance, the uppermost ply through the already formed ply or plies which are located for instance therebelow, and hence, it is necessary to overcome the prevailing dewatering resistance. This requires a relatively long pre-dewatering path with correspondingly longer dewatering times. Additionally, fibers can tend to again deflocculate, so that the formation of the fibers in the already formed layer or ply is impaired.

SUMMARY OF THE INVENTION

Therefore, with the foregoing in mind it is a primary object of the present invention to provide a new and improved construction of papermaking machine which is not associated with the aforementioned drawbacks and limitations of the prior art heretofore discussed.

Another and more specific object of the present invention aims at providing a new and improved construction of a papermaking machine of the previously mentioned type which is particularly suitable for the fabrication of multi-ply paper and affords improved dewatering of the fiber web.

Still a further significant object of the present invention is directed to a new and improved construction of papermaking machine which is relatively simple in design, quite economical to manufacture, extremely reliable in operation, not readily subject to breakdown or malfunction, requires a minimum of maintenance and servicing, and enables realization of improved dewatering of a paper web composed of multiple plies or layers.

Now in order to implement these and still further objects of the invention, which will become more readily apparent as the description proceeds, the twin-wire papermaking machine of the present development is manifested by the features that at the end of the pre-dewatering path there is arranged a further headbox which is located forwardly or upstream of an inbound or run-on location of the second wire.

Due to the provision of the further or second headbox which is arranged, according to the invention, following or downstream of the first headbox, the fiber stock suspension or stock jet effluxing out of such further headbox is deposited upon the already extensively downwardly dewatered stock layer or ply reposing upon the pre-dewatering path and which was previously formed by the first headbox. At the region of the common dewatering path of both wires which merges with the inbound or run-on location of the second wire there is upwardly dewatered the last deposited ply or layer. In this way there can be counteracted an admixing of both layers or plys and there is avoided impairment of the fiber formation of the first ply by dewatering of the second ply.

The papermaking machine can be provided with a guide path which is convexly domed or arched with respect to the first wire and which is arranged at the region of the common path of both wires. This guide path possesses an essentially water impervious support surface for the first wire. This arrangement ensures, in a particularly simple manner, a separation of the dewatering operations, and thus, dewatering of the second fiber ply or layer in a manner which practically does not affect the condition of the first fiber ply or layer.

According to a further aspect of the invention at least a part of the support surface neighbouring the inbound or run-on location of the second wire can be formed at a contact or slide surface of a slide or guide shoe or equivalent structure. With this design there is rendered possible an optimum adjustment of the inbound or run-on location of the second wire which forms the flow upstream boundary of the common dewatering path. Hence, there is ensured for a desirable guiding of both wires which is particularly advantageous for dewatering the second fiber ply.

It is possible for at least a portion of the support surface to be formed by a section or part of a jacket or outer surface of a rotatable guide cylinder or roll. This allows for separate dewatering of the second fiber ply with particularly protective guiding of the first fiber ply.

Moreover, the pre-dewatering path can contain a guide cylinder or roll about which is wrapped the first wire of the papermaking machine and a third wire. The infeed of the stock suspension through the first headbox can be accomplished between both of these wires. With this design the pre-dewatering path extends over the region of the guide cylinder which is wrapped by the first wire and the third wire, so that such cylinder—in comparison to constructions working with planar pre-dewatering paths—can be arranged at a smaller spacing from the inbound or run-on location of the second wire. Consequently, there is beneficially realized a reduction in the structural length of the papermaking machine.

According to a further aspect of the invention it is possible to guide the first wire over an additional convex domed guide path towards an additional wire. This additional convex curved or domed guide path is arranged following the second wire. The additional wire delimits in conjunction with the first wire, at the region of the convex domed guide path, a substantially wedge-shaped gap or throat and forms an additional common dewatering path merging at such gap or throat. Forwardly of the inbound or run-on location of the first wire at the additional wire there is arranged at least one additional headbox which is directed towards the additional wire. With this arrangement there is possible the separate dewatering of at least three fiber plies in each case before they are joined together, without impairing the formation of the other pliers or layers.

The additional guide path can possess a water impervious guide or contact surface and the additional headbox can be directed towards the wedge-shaped throat or gap. Consequently, there is afforded a particularly intensive dewatering of the fiber ply formed by the additional headbox.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
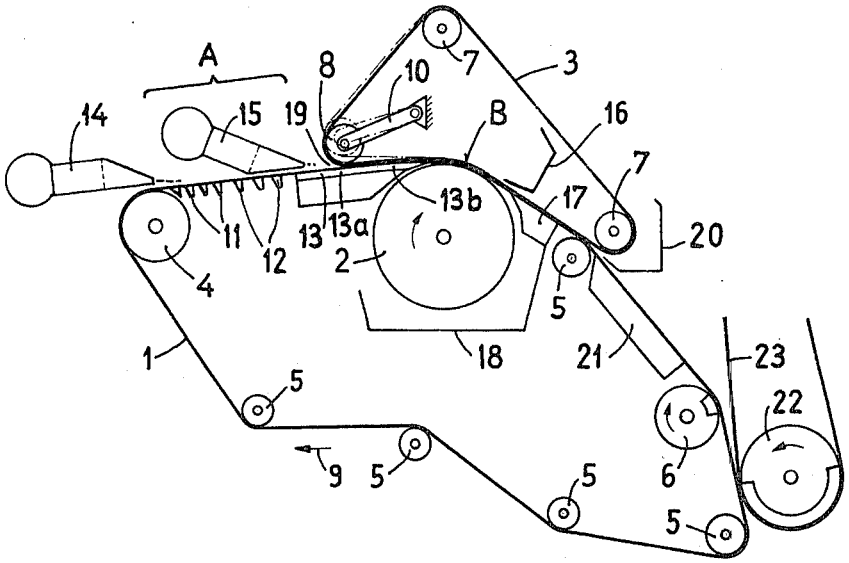
FIG. 1 is a schematic illustration of a twin-wire papermaking machine constructed according to the invention.

Describing now the drawings, it is to be understood that only enough of the construction of the various embodiments of papermaking machines disclosed herein by way of example and not limitation, has been shown as will enable those skilled in this art to readily understand the underlying principles and concepts of the present development, while simplifying the illustration of the drawings. Turning attention therefore now particularly to the exemplary embodiment of twin-wire papermaking machine illustrated in FIG. 1, it will be seen that the same contains a first inner wire 1 which is guided over a water impervious smooth jacket or outer surface of a dewatering cylinder or roll 2. Additionally, there is provided a second outer wire 3 which likewise is guided over the dewatering cylinder 2 and which coacts with the inner wire 1 along a common path B. The inner wire 1 is guided over a breast roll 4 and guide rolls 5, one of which is constructed in known manner as a tensioning roll, as well as over a suction cylinder or roll 6. The outer wire 3 extends at the region of the common path B along the outer side or surface of the inner wire 1 which faces away from the dewatering cylinder 2 and is guided over guide rolls 7, one of which here also is conventionally constructed as a tensioning roll, as well as over an adjustable guide roll 8 towards the inner wire 1. The wires 1 and 3 delimit therebetween a substantially wedge-shaped infeed throat or gap 19. The guide roll 8 is rotatably mounted at a pivotal arm 10 or equivalent structure and by means of such pivotal arm 10 this guide roll 8 can be selectively adjustably positioned between the position shown in full lines and the position shown in phantom lines in FIG. 1.

Viewed with respect to the direction of travel or movement of the inner wire 1, generally indicated by the arrow 9, this inner wire 1 is guided at a section or portion A of its course of travel which merges with the breast roll 4 over the wire tables 11 and suction foils 12 or equivalent structure. Following the suction foils 12 the inner wire 1 is then guided over a smooth contact or slide surface 13*a* of an essentially water impervious slide or guide shoe 13 which is arranged forwardly or upstream of the dewatering cylinder 2 at a small spacing therefrom. The end 13*b* of this slide shoe or shoe member 13, which confronts the dewatering cylinder 2, possesses a domed or arched portion which extends in the direction of movement 9 of the inner wire 1 and is convexly curved with respect to such wire 1. By means of the slide shoe 13, as is well known from the aforementioned U.S. Pat. No. 4,176,005, there is determined the position of the inbound or run-on location of the outer wire 3 at the inner wire 1 and corresponding to the operating position of the guide roll 8 which has been shown in full or solid lines in FIG. 1. On the other hand, the inbound or run-on location of the outer wire 3, corresponding to the phantom line position of the guide roll 8, is located externally of the slide or guide shoe 13 at the circumference of the dewatering cylinder 2.

At the starting portion of the section or region A there is arranged a first headbox 14 for forming a fiber ply or layer. This section A constitutes an essentially linearly extending pre-dewatering path where the fiber ply formed by the headbox 14 is dewatered essentially in a downward direction. At the end of the section A there is arranged a second headbox 15 serving for forming a second fiber ply or layer. This second headbox 15 is directed towards the infeed throat or gap 19. Consequently, the fiber ply or layer formed by the second headbox 15 is deposited onto the extensively dewatered fiber ply or layer formed by the first headbox 14. This subsequently deposited fiber ply is dewatered essentially upwardly at the region of the common path B through the outer wire 3, and the smooth contact surfaces of the slide or guide shoe 13 and the dewatering cylinder 2 prevent dewatering of the fiber web in downward direction. At the region of the location where both of the wires 1 and 3 run-off the dewatering cylinder or roll 2 there is arranged a catch container or receptacle 16 for spray water or water spatters which have been propelled away from the dewatering region. Additionally, both of the wires 1 and 3 are guided over a support element 17 which can be constructed as a suction box and which is connected with a catch container or receptacle 18 which extends about the dewatering cylinder or roll 2.

The common path B of the wires 1 and 3 terminates at the guide roll 5 of the inner wire 1 which follows the support element 17. At the location of this guide roll 5 the outer wire 3 is lifted-off of the inner wire 1 and is guided back by means of the guide rolls 7 and 8 to the inbound or run-on location. Near the lift-off location of the outer wire 3 from the inner wire 1 there is arranged a further catch container or receptacle 20. This catch container 20 prevents spattering of the double-ply fiber web bearing upon the inner wire 1 by spray water which has been propelled away from the outer wire 3. The wire 1 together with the double-ply fiber web is guided between the outbound or run-off location of the two wires 1 and 3 and a suction cylinder or roll 6 over a suction box 21 or equivalent structure, so that there is accomplished a further dewatering of the fiber web.

At the section following the suction cylinder or roll 6 the inner wire 1 is contacted by a suction and press cylinder 22 over which there is guided a pick-off felt 23 intended for removal or take-over of the formed fiber web. From the location of the pick-up felt 23 the fiber web is infed in known manner by means of further not here particularly illustrated but conventional components, for instance a press or contact roll, to a likewise not particularly shown drying device of the papermaking machine which is unimportant as to its details in so far as the subject matter of the present invention in concerned.

During operation, the fiber ply formed by the first headbox 14 is downwardly dewatered at the region of the linear section or path A with an intensity which increases in the direction of movement 9 of the inner wire 1. Such dewatering is accomplished at the region of the wire table 11 by the action of the force of gravity and thereafter by the action of the suction foils 12. The fiber ply formed by the second headbox 15 is deposited upon the first fiber ply and is upwardly dewatered at the region of the common path B of both wires 1 and 3 with an intensity which increases in the direction of movement of such wires 1 and 3. The dewatering initially occurs at a reduced compressive or pressure force, which is dependent upon the wire tension and the centrifugal force effective at the slide or guide shoe 13, and thereafter is accomplished with increased compressive force at the region of the dewatering cylinder 2 about which there are wrapped or trained both of the wires 1 and 3. By means of the adjustable guide roll 8 it is possible to adjust, in known manner, a suitable inbound or infeed angle between the wires 1 and 3, in order to obtain a gradual pressure increase during the dewatering of the fiber ply or layer formed by the second headbox 15.

With the double-ply paper fabricated in the aforedescribed manner both of the plies or layers are dewatered independently of one another, and, in particular, there is beneficially avoided an impairment of the fiber formation in the first ply or layer formed by the first headbox 14, something which was possible with the heretofore known prior art constructions of papermaking machines. The extensively dewatered paper web which egresses out of the region of the wrap angle of the dewatering cylinder 2, as a general rule, already possesses a sufficient strength and the desired structure which therefore is no longer impaired by the subsequent, additional dewatering operations which occur at the region of the guide or support element 17 and the suction box 21.

Figure 2:
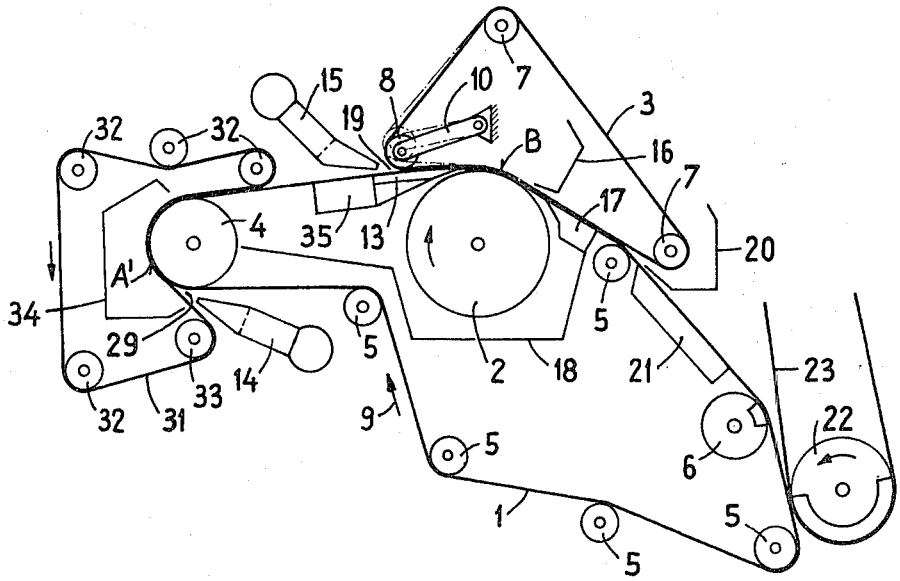
FIG. 2 schematically illustrates a second embodiment of papermaking machine constructed according to the invention.

With the papermaking machine illustrated in the modified embodiment of FIG. 2, the first wire 1 is guided over a larger wrap angle about the breast roll 4 than with the embodiment of papermaking machine disclosed above with reference to FIG. 1. The wire 1 acts at a section A' extending along the breast roll 4 upon a common path in conjunction with a third wire 31 which likewise partially wraps about the breast roll 4. The third wire 31 is guided about guide rolls 32, of which one such guide roll likewise can be constructed as a tensioning roll. This third wire 31 is also guided over a guide roll 33 which, in the illustrated exemplary embodiment, is located below the breast roll 4 and can be arranged to be adjustable, if desired, in relation to such breast roll 4. The wires 1 and 31 delimit a substantially wedge-shaped inbound or infeed throat or gap 29.

The first headbox 14 is here arranged beneath the breast roll 4 and is directed at an inclination upwardly towards the infeed gap or throat 29. Consequently, the common path of both wires 1 and 31, located at the section A', forms the pre-dewatering path for the fiber ply or layer formed by the first headbox 14. This thus formed fiber ply is dewatered outwardly, and hence, essentially downwardly, because of the wire tension effective at the wrap angle of the breast roll 4 and the centrifugal force, through the wire 31. The region of the breast roll 4 which is wrapped by both of the wires 1 and 31 is surrounded by a catch container or receptacle 34 for the spray water which is formed at such region.

With the embodiment of papermaking machine depicted in FIG. 2 the pre-dewatering path for the fiber ply or layer formed by the first headbox 14 is shifted to the wrap region of the breast roll 4, so that such roll, in comparison to the arrangement of FIG. 1, can be located closer to the slide or guide shoe 13. This, in turn, renders possible a more compact construction of the papermaking machine.

As will be likewise evident by reverting to FIG. 2, the slide or guide shoe 13 also can merge approximately at a suction box 35 which continues the pre-dewatering of the first fiber ply or layer. This suction box 35, viewed in the direction of movement of the wire 1, indicated by the arrow 9, extends up to a point shortly before the impact location of the stock jet or stream effluxing out of the second headbox 15 of the wire 1.

Figure 3:
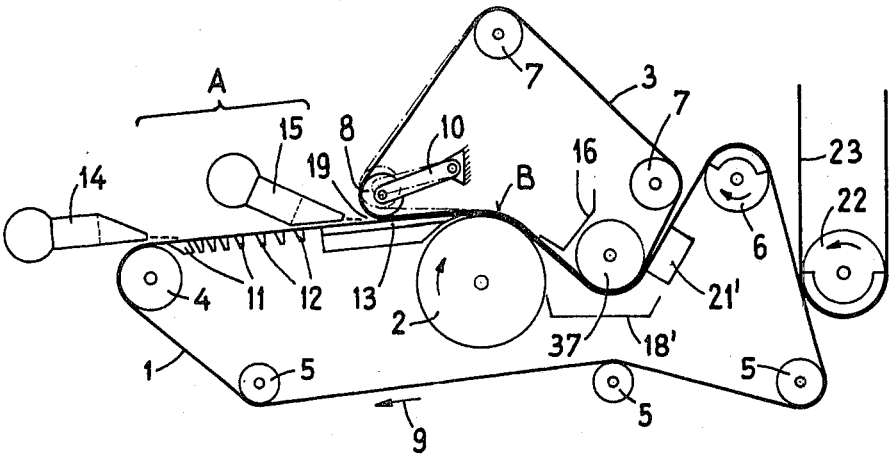
FIG. 3 schematically illustrates a third embodiment of papermaking machine constructed according to the invention.

The variant construction of papermaking machine shown in FIG. 3 essentially corresponds to the embodiment of FIG. 1, with the difference that here both of the wires 1 and 3 are additionally guided, at the region of their common path B, through a relatively large wrap or training angle about a deflection roll 37 arranged after the dewatering cylinder 2. Between the deflection roll 37 and the suction roll 6 there can be arranged a suction box 21' corresponding to the suction box 21 of the arrangement of FIG. 1, in order to ensure for the detachment of the double-ply fiber web from the wire 3 and a continuation of the dewatering of the fiber web. Arranged beneath the deflection roll 37 is a catch container or receptacle 18' for capturing the spray water which is formed at the region of the deflection roll 37.

Figure 4:
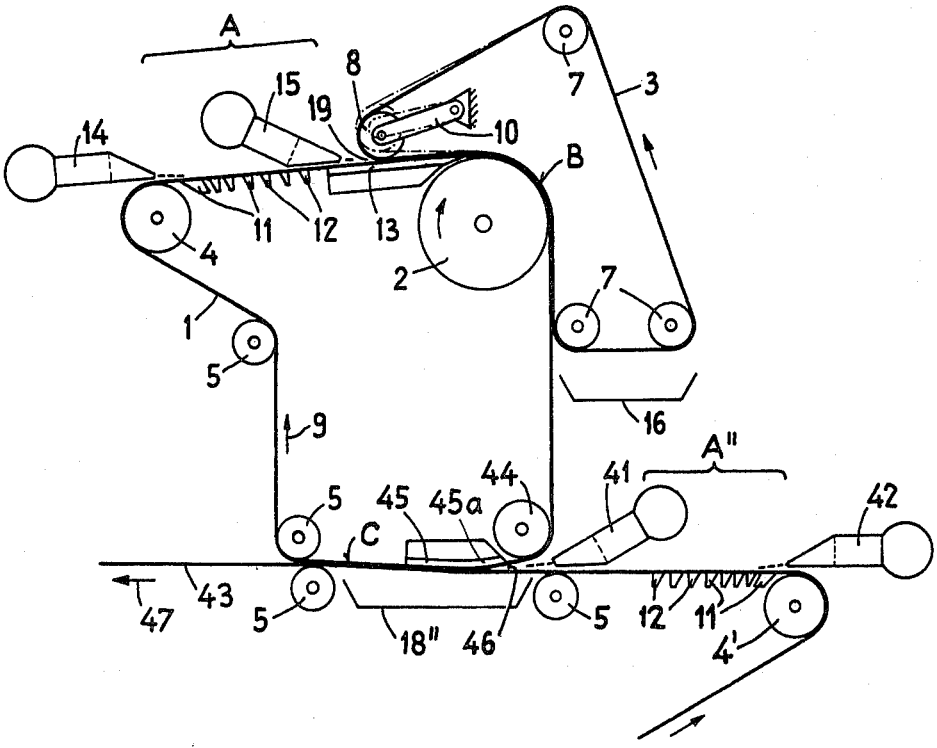
FIG. 4 schematically illustrates a fourth embodiment of papermaking machine constructed according to the invention.

The embodiment of papermaking machine depicted in FIG. 4 additionally contains, apart from both of the headboxes 14 and 15, two further headboxes 41 and 42 as well as an additional or third wire 43 which is arranged beneath the first wire 1 and co-travels along therewith through a common path C. The wire 1 is guided over a deflection roll 44 arranged beneath the dewatering cylinder 2. This wire 1 is also guided over a slide or guide shoe 45 arranged following the deflection roll 44 in the direction of wire movement indicated by the arrow 9. The slide or guide shoe 45 is provided with a convex domed or arched water impervious contact or slide surface **45*a* and the wire 1 is guided towards a section of the wire 43 which extends essentially in horizontal direction and contains the common path C. The wire 43 is guided over a breast roll 4', and at a section A'' arranged forwardly of the common path C this wire 43 is guided over a pre-dewatering path constituted by the wire tables 11 and the suction foils 12 as well as over the guide rolls 5 and over additional not here particularly illustrated guide elements. Both of the wires 1** and 43 delimit at the region of the slide or guide shoe 45 a substantially wedge-shaped infeed gap or throat 46.

The third headbox 41 is arranged at the end of the section A" and is directed towards the infeed gap or throat 46. The fourth headbox 42 is arranged at the starting region of the section A" and is directed towards the third wire 43. Beneath the deflection roll 44 and the slide shoe 45 there is provided a catch container or receptacle 18" for spray water or water spatters which are formed at the region of the common path C.

During operation, both of the fiber plies or layers which are formed by the headboxes 14 and 15 and adhering to the inner wire 1 are united with a third fiber layer or ply formed by the headbox 41 and a fourth fiber layer or ply formed by the headbox 42, and the fourth fiber ply is downwardly dewatered at the region of the section A". The third fiber layer is likewise downwardly dewatered upon passage through the infeed gap or throat 46 and at the region of the common path C through the fourth fiber ply. The fiber web formed of the four fiber plies or layers is thereafter infed, in the direction of the arrow 47, over not particularly illustrated, but conventionally known guide elements to further working regions of the papermaking machine.

As to the paper fabricated at the papermaking machine according to the embodiment of FIG. 4 the first ply formed by the headbox 14 can constitute, for instance, a white cover layer, the second ply formed by the headbox 15 can constitute a protective layer, the third ply formed by the headbox 41 can constitute an insert layer, and the fourth ply formed by the headbox 42 can constitute a carrier layer forming the rear side or face of the paper.

It should be understood that with the embodiment of FIG. 4, for instance for fabricating paper formed of three plies or layers, one of the headboxes, for instance the headbox 42, together with the therewith operatively correlated pre-dewatering path A", can be omitted. Consequently, also the fiber ply formed by the headbox 41 can be downwardly dewatered without effecting another ply.

With the embodiment of FIG. 4 the slide or guide shoe 45 also can possess a water pervious contact or slide surface and can coact with a suction box or equivalent structure. As a result, the dewatering of both fiber plies formed by the headboxes 14 and 15 also can progress or continue during the dewatering of the fiber plies formed by the headboxes 41 and 42.

While there are shown and described present preferred embodiments of the invention it is to be distinctly understood that the invention is not limited thereto, but may be otherwise variously embodied and practiced within the scope of the following claims. Accordingly,

What we claim is:

1. A twin-wire papermaking machine comprising:

a first wire at which there is formed a first fiber ply;

said first wire moving in a predetermined direction of travel and defining a wire loop;

a second wire positioned to be brought together with the first wire;

a first headbox for infeeding a stock suspension for forming said first ply at said first wire;

means defining a pre-dewatering path arranged following the first headbox for dewatering the first fiber ply essentially downwardly at the first wire;

said means defining said pre-dewatering path comprising at least a portion of said first wire;

said second wire coming into contact with the first wire at a predetermined inbound location;

a second headbox for infeeding a stock suspension arranged at an end of pre-dewatering path forwardly of said inbound location of said wire;

means arranged following the second headbox and defining a dewatering path for dewatering a fiber ply essentially upwardly;

said means defining said dewatering path for essentially upwardly dewatering the fiber ply comprising a substantially curvilinearly extending common portion of both said first and second wires;

a dewatering element defining an essentially water impervious guide path over which there is guided said common portion of said first and second wires;

said dewatering element being arranged in the wire loop of said first wire;

a slide shoe arranged upstream of said dewatering element with respect to the direction of travel of said first wire for guiding said first wire;

said slide shoe possessing a water impervious support surface for said first wire; and said water impervious support surface extending upstream out of the region of the inbound location of said second wire with respect to said direction of travel of the first wire past an impact location of the stock suspension effluxing out of the second headbox and directed towards the first wire.

2. The twin-wire papermaking machine as defined in claim 1, wherein:

said portion of said first wire defining said pre-dewatering path comprises an essentially linearly extending portion of said first wire.

3. The twin-wire papermaking machine as defined in claim 1, wherein:

said water impervious support surface of the slide shoe extends upstream into at least close proximity to the efflux location of the stock suspension from the second headbox.

4. The twin-wire papermaking machine as defined in claim 1, wherein:

said water impervious support surface of the slide shoe possesses a domed portion which is convex with respect to said first wire.

5. The twin-wire papermaking machine as defined in claim 4, wherein:

at least a portion of the water impervious guide path is formed by a portion of an outer surface of a rotatable dewatering cylinder defining said dewatering element.

6. The twin-wire papermaking machine as defined in claim 1, wherein:

at least a portion of the water impervious guide path is formed by a portion of an outer surface of a rotatable dewatering cylinder defining said dewatering element.

7. The twin-wire papermaking machine as defined in claim 1, further including:

a third wire;

said essentially downwardly effective pre-dewatering path comprising a breast roll about which there is trained said first wire and said third wire;

said third wire being guided together with said first wire at a circumferential region of said breast roll in order to form a substantially wedge-shaped infeed throat; and said first headbox being directed towards said substantially wedge-shaped infeed throat.

8. The twin-wire papermaking machine as defined in claim 1, further including:

an additional dewatering element arranged following said second wire and within the loop of the first wire;

said additional dewatering element possessing a water impervious slide surface;

an additional wire;

said first wire being guided over said additional dewatering element and being brought into coacting relationship with said additional wire to form both a substantially wedge-shaped gap and an additional common dewatering path arranged after said wedge-shaped gap;

an additional headbox for infeeding a stock suspension and directed towards said wedge-shaped gap;

said additional wire coming into contact with said first wire at a predetermined inbound location;

said additional dewatering element containing a water impervious support surface at the region of the inbound location of said additional wire;

said substantially water impervious support surface of said additional dewatering element extending upstream with regard to the direction of travel of the first wire; and said water impervious support surface of said additional dewatering element extending beyond an impact location of the stock suspension which is infed by said additional headbox and directed towards the additional wire.

* * * * *